United States Patent [19]

de Filippis et al.

[11] 4,233,770

[45] Nov. 18, 1980

[54] LASER AIMING DEVICE FOR WEAPONS

[76] Inventors: Gerald de Filippis, 10, Avenue Vulliemin; Jean M. Henry, 20 bis, Montagibert Ave.,, both of 1005 Lausanne, Switzerland

[21] Appl. No.: 953,585

[22] Filed: Oct. 23, 1978

[51] Int. Cl.[3] ..... F41G 1/36

[52] U.S. Cl. ..... 42/1 A

[58] Field of Search ..... 42/1 A, 1 ST; 89/41 L, 89/41 B; 362/113

[56] References Cited

U.S. PATENT DOCUMENTS

| | | | |
|---|---|---|---|
| 3,454,898 | 7/1969 | Comstock | 42/1 A |
| 4,026,054 | 5/1977 | Snyder | 42/1 A |
| 4,079,534 | 3/1978 | Snyder | 42/1 A |
| 4,112,300 | 9/1978 | Hall, Jr. et al. | 89/41 L |
| 4,152,754 | 5/1979 | de Filippis et al. | 42/1 A |

*Primary Examiner*—Charles T. Jordan

*Attorney, Agent, or Firm*—Ostrolenk, Faber, Gerb & Soffen

[57] ABSTRACT

A laser is attached to a weapon and its beam is aimed toward the target. The dot of laser light on the target is observed through a light filter which permits passage of light of the same wavelength as the laser light. The filter may also be removed from the line of sight to the target.

12 Claims, 3 Drawing Figures

FIG. 1
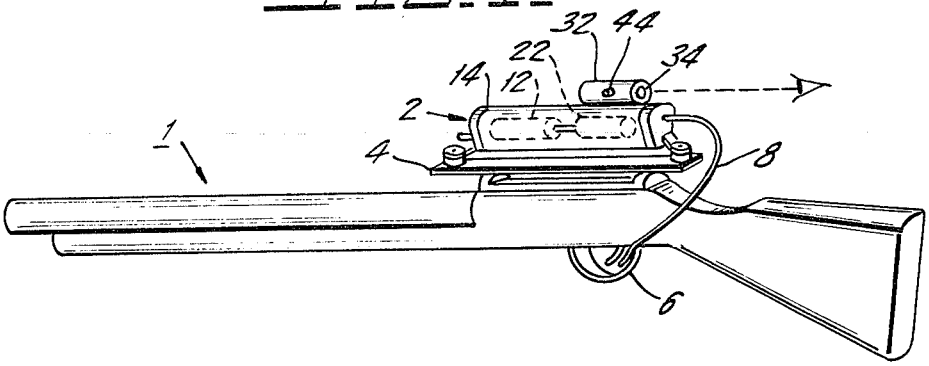
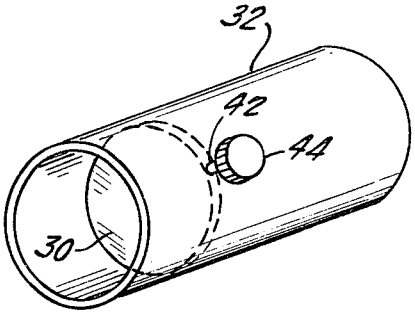
FIG. 2
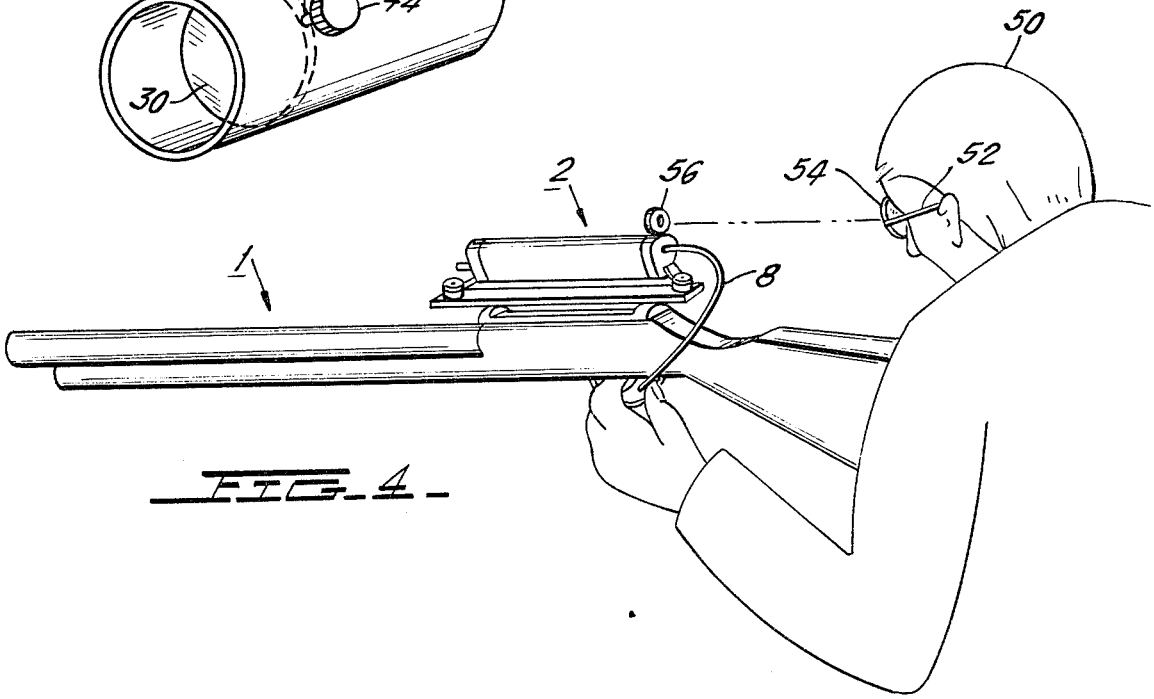
FIG. 4
FIG. 3
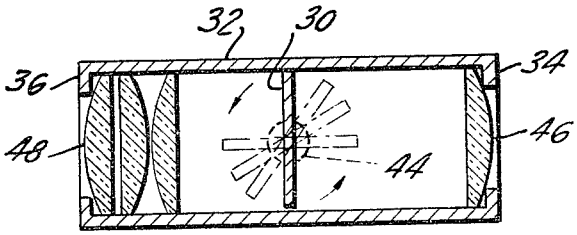

LASER AIMING DEVICE FOR WEAPONS

BACKGROUND OF THE INVENTION

The present invention relates to an aiming device for any weapon that fires a projectile at a target which is in the line of sight from the weapon. More particularly, the invention relates to a laser aiming device which shines a laser beam on the target and enables a marksman to preview the area of anticipated impact of the projectile.

Aiming a weapon is often difficult. The target sighting device, i.e., the gunsight of the weapon, must be placed at the marksman's eye, and especially with hand-held weapons such as rifles and the like, this may not be a comfortable or steady position for holding or firing the weapon. Further, the usual procedures of sighting on a target and the designs of standard sighting devices greatly restrict the marksman's field of view of the target and, on occasion, time must be spent to locate the target in the sighting device. Additionally, a marksman may have to close one eye to adequately sight on a target, greatly restricting his field of view and rendering him unable to know about events taking place in his immediate vicinity. Conventional aiming devices do not permit the marksman or operator of the weapon to preview precisely the impact area of the weapon but only permit the marksman to visualize the general field of the target. As a result, aiming efficiency is rather low. The aiming efficiency can be improved with the help of specialized equipment, such as radar, which requires additional experienced personnel for its operation. Still further, weapons must often be fired at poorly visible targets, e.g., at obscure targets and under unfavorable weather conditions. Additionally, great speed of aiming and ease of aiming are both hard to attain with conventional aiming devices.

Conventional weapon aiming devices are either optical and use front and rear sights, or they are infrared, or they are optical and mechanical or electromechanical as in larger guns such as tank guns, or they are electronic as used with non-manually controlled weapons such as antiaircraft weapons, particularly those controlled by radar. Each of the various conventional techniques of aiming a weapon has at least some of the above described drawbacks.

One technique for overcoming the foregoing difficulties encountered in aiming a weapon is to project a laser beam or other appropriate light beam onto the target. When the target is illuminated by the laser or light beam, the trigger of the weapon is operated. If the laser or other light beam is properly zeroed in on the aiming point of the weapon, the projectile fired by the weapon will strike where the light is shining. An improved device of this type is described in copending application Ser. No. 769,533, now U.S. Pat. No. 4,152,754, the disclosure of which is hereby incorporated by reference. That device includes a mounting support which is fixedly attached to the weapon and the rest of the laser aiming device is attached to its mounting support. The aiming device includes zeroing means connected between the mounting support and the rest of the device and which enable the aiming point of the laser beam to be readjusted up and down or sideways after the aiming device is mounted on the weapon.

In laser aiming devices, when the laser is operated, the laser beam is projected toward the target and is normally invisible. When it strikes the target, it forms a visible dot thereon. When the marksman has moved the weapon so that the visible dot is over the target, he operates the weapon. In the aiming device of the aforesaid application, the laser is activated by the marksman partially squeezing the trigger of the weapon. With the trigger partially squeezed, the weapon is aimed. When the weapon has been aimed, the marksman completes operating the trigger of the weapon. The projectile fired from the weapon should impact on the illuminated target if the laser beam has been properly zeroed in with the weapon.

In any laser aiming device for use on a weapon, such as a rifle, the laser emits a monochromatic light beam, e.g. a red color light. At night, during heavily overcast conditions, indoors or in a darkened environment, the beam of light shining on the target is easily visible. However, outdoors during the day and in a bright environment, the ambient light effectively overwhelms the dot of laser light on the target making it difficult for the marksman to observe.

SUMMARY OF THE INVENTION

Accordingly, it is the object of this invention to provide an improved aiming device for a weapon which has the benefits described above and which avoids the drawbacks of the prior art described above, particularly the difficulty in observing the illuminated target under daylight or brightly lit conditions.

This invention relates to a weapon aiming device particularly adapted for use under daylight or other brightly lit conditions and more particularly to a device comprising in combination a monochromatic light source, which is typically a laser, means connected to the light source for supplying power thereto, means for directing light emitted by the light source in an aiming direction, means to activate the light source, and means to view the area illuminated by the emitted light, which includes a light filter of the same wavelength as the laser beam (within tolerance limits), which permits passage of light of the same wavelength as the emitted light through the filter and blocks light of other wavelengths from passing through.

The foregoing and other objects and features of the invention will become apparent to those skilled in the art from the following detailed description taken in conjunction with the accompanying drawings.

BRIEF DESCRIPTION OF THE DRAWING AND FIGURES

FIG. 1 is a view of a rifle fitted with an aiming device according to a first embodiment of the present invention;

FIG. 2 is a perspective view of the aiming device of FIG. 1;

FIG. 3 is a cross-sectional view in elevation of the aiming device; and

FIG. 4 is a view of a second embodiment of the aiming device according to the invention.

DESCRIPTION OF THE PREFERRED EMBODIMENT

FIG. 1 is a perspective view of a rifle 1 fitted with an aiming device according to the present invention. The aiming device includes a laser emitting device 2, of the type described in aforesaid Application Ser. No. 769,533 or of any other of the types known in this art. The laser emitting device 2 is fastened on top of the rifle 1 by appropriate attachment means 4, such as that shown in the above noted Application, although the laser emitting device might be attached beneath the rifle also. The laser emitting device 2 is activated by an operator 6 which acts through a cable 8 leading to the laser emitting device 2, as further detailed in the Application.

A battery operated laser lamp or light source 12 is supported in the housing of the device 2.

The front end plate 14 of the housing of the laser emitting device carries a laser beam outlet through which the laser light is directed at the target (not shown).

The laser 12 can be a standard helium-neon laser operating at 5 milliwatt. An appropriate battery-transformer power source 22 such as that described in the Application, supplies power used by the laser. A laser beam is a luminous coherent monochromatic collimated light ray. In the above-mentioned laser, the emitted laser light beam is red in color, e.g. a wavelength of 633 milliradians. The illustrated red light emitting laser was selected because it can be made small in size and light in weight. As appropriate, any other wavelength laser may be used.

It is usually difficult to see the laser light beam in the air unless the beam passes through smoke or floating particulates, or the like. However, when the laser beam strikes the target, it forms a visible monochromatic dot thereon. In a darkened environment, the dot is clearly visible to the marksman. But in a bright environment, e.g. bright sunlight, the sunlight includes all wavelengths of visible light and the laser light is mixed with all other colors of light. Furthermore, the ambient light so brightly illuminates the area surrounding the target and overwhelms the laser light dot thereby making the dot on the target difficult to observe.

This difficulty is overcome in the present invention by the marksman observing the target through a suitable light filter which is precisely the same wavelength as and which therefore passes light of precisely the same wavelength as, the laser light, within minimal tolerance limits of ±30 manometers. For example, when the light has a wavelength of 633 milliradians, the filter has the same wavelength, ±30 manometers. As the marksman looks at the illuminated target through the filter, the filter excludes all light except for light of its wavelength, and the filter thus darkens the markman's view of the area around the laser light dot on the target while the laser light dot on the target remains quite bright. The filter can be included as a part of the gunsight or viewing scope on the weapon or can be placed on the weapon where the sight or scope would otherwise be placed. It may be placed adjacent to the laser source on the weapon or be remote therefrom. A further alternative, although less preferred, is to provide the user of the weapon with a pair of eyeglasses having lenses which are filters of the desired wavelength.

One embodiment for the mounting of the light filter is shown in FIG. 1.

The light filter 30 of the first embodiment is supported in a light filter support housing 32 which is affixed atop the housing 2 for the laser source 12. The placement of the housing 32 positions the filter 30 on the rifle where a typical sight or scope might be placed. The housing 32 is comprised of a hollow cylindrical tube of metal with peripheral radially inwardly extending end flanges 34 at the end through which the operator looks and 36 at the end facing the target. The filter 30 is comprised of a planar glass lens of the precise wavelength of the laser light, within tolerance limits. The lens 30 is supported at its edge on a shaft 42 which is drivingly attached to an operating knob 44. As shown in FIG. 3, rotation of the knob 44 will rotate the lens 30 from the position shown in FIG. 2, which is its solid line position in FIG. 3 at which the operator of the weapon looks through the filter 30, to the horizontal orientation shown in FIG. 3, at which the operator sees the edge of the filter and the filter thereby appears to him to be a thick line running horizontally across the viewing field.

The housing 32 is sealed at the operator's end by lens system 46 and at the target end by lens system 48 which are, for example, conventional lens systems found in a typical telescopic rifle sight or scope. As ambient light conditions dictate and as it becomes more or less difficult to see the dot of laser light on the target, the filter 30 is selectively swiveled around shaft 42 into and out of position to be used.

In the second embodiment of the invention shown in FIG. 4, the rifle 1 is essentially the same rifle as the rifle shown in the embodiment of FIG. 1. However, there is no filter 30 on the rifle itself. Instead, the marksman 50 wears a pair of removable spectacles 52, the lenses 54 of which are comprised of glass of the same wavelength as the laser light, within tolerance limits. In an obvious variation, the operator may wear a contact lens of the correct wavelength over the cornea of his eye. As ambient light conditions dictate, the marksman dons or removes the spectacles 52 or the contact lens which, respectively, gives him a filtered view of the illuminated area of the target or an unencumbered view of that area of the target. The marksman looks at the target (not shown) through the sight 50 or another conventional scope.

Note that in all embodiments of the invention, even if the rifle is provided with a standard gunsight, the aiming of the weapon does not rely upon the gunsight but instead relies upon the beam of laser light illuminating an area of the target and the viewing of the illuminated area through a filter adapted to permit passage of light of an appropriate wavelength.

Although the present invention has been described in conjunction with preferred embodiments thereof, many variations and modifications will now become apparent to those skilled in the art. It is preferred, therefore, that the present invention be limited not by the specific disclosure herein, but only by the appended claims.

We claim:

1. A weapon aiming device comprising, a monochromatic light source, means for directing monochromatic light emitted by said light source in an aiming direction, means for activating said light source and being connected to said light source, and means for viewing a target area illuminated by the emitted light comprising a light filter which permits passage therethrough of light of the same wavelength as the emitted light within tolerance limits.

2. The weapon aiming device of claim 1, wherein said filter is the same wavelength as the monochromatic light, with tolerance limits.

3. The weapon aiming device of claim 2 wherein said light source is a laser.

4. The weapon aiming device of claim 2, further comprising means connected to said light source for supplying power thereto.

5. The weapon aiming device of claim 2, further comprising a weapon to be aimed, said light source being supported on said weapon and being aimed toward a target area to be illuminated, said means for viewing also being supported on said weapon and being generally aimed toward the target area to be illuminated.

6. The weapon aiming device of claim 2, further comprising a weapon to be aimed, said means for viewing being supported on said weapon and being generally aimed toward a target area to be illuminated.

7. The weapon aiming device of either of claims 5 or 6, wherein said means for viewing is movable in position, with respect to the weapon, between a viewing position, which enables viewing through the filter of the illuminated target area, and a non-viewing position.

8. The weapon aiming device of claim 7 wherein said light source is a laser.

9. The weapon aiming device of either of claims 2 or 3, wherein said means for viewing is separate from the weapon being aimed.

10. The weapon aiming device of claim 9, wherein said means for viewing comprises a lens in the form of said light filter carried by the marksman at his eye for viewing the target.

11. The weapon aiming device of claim 10, wherein said means for viewing comprises spectacles including said lens.

12. The weapon aiming device of claim 10, further comprising a weapon to be aimed, said light source being supported on said weapon.

* * * * *